US007370986B2

(12) United States Patent
Chan

(10) Patent No.: US 7,370,986 B2
(45) Date of Patent: May 13, 2008

(54) LAMP BODY FOR A FLUORESCENT LAMP

(75) Inventor: Cheng-Ron Chan, Younghe (TW)

(73) Assignee: GAYA Co., Ltd., Tainan (TW)

( * ) Notice: Subject to any disclaimer, the term of this patent is extended or adjusted under 35 U.S.C. 154(b) by 0 days.

(21) Appl. No.: 11/488,609

(22) Filed: Jul. 19, 2006

(65) Prior Publication Data

US 2008/0019132 A1 Jan. 24, 2008

(51) Int. Cl.
*F21Y 103/00* (2006.01)

(52) U.S. Cl. ..... 362/84; 362/260

(58) Field of Classification Search ..... 362/84, 362/260, 217, 216

See application file for complete search history.

(56) References Cited

U.S. PATENT DOCUMENTS 3,115,309 A * 12/1963 Spencer et al. ..... 362/217
4,695,763 A * 9/1987 Ogasawara et al. ..... 313/487
5,889,366 A * 3/1999 Yokokawa et al. ..... 313/607
6,890,087 B2 * 5/2005 Ono ..... 362/260
2005/0094399 A1 * 5/2005 Cull et al. ..... 362/255

* cited by examiner

*Primary Examiner*—Laura Tso
(74) *Attorney, Agent, or Firm*—Muncy, Geissler, Olds & Lowe, PLLC

(57) ABSTRACT

A lamp body for a fluorescent lamp has multiple sections arranged on an inner surface of the lamp body. The sections include at least one coated section coated with fluorescent powders and at least one non-coated section being naked and kept free from fluorescent powders. The fluorescent powders generate visible lights when colliding with ultraviolet rays. The visible lights can directly pass out of the lamp body through the at least one non-coated section to form a light source and improve a luminance of the fluorescent lamp.

8 Claims, 6 Drawing Sheets

LAMP BODY FOR A FLUORESCENT LAMP

BACKGROUND OF THE INVENTION

1. Field of the Invention

The present invention relates to a lamp body for a fluorescent lamp, and more particularly to the lamp body that can improve the luminance ratio of the fluorescent lamp.

2. Description of Related Art

A conventional fluorescent lamp has a lamp body, a positive electrode and a negative electrode. The lamp body is filled with mercury and inert gas and has two ends and an inner surface. The inner surface of the lamp body is coated with fluorescent powders. The positive electrode and the negative electrode are mounted respectively at the two ends of the lamp body. When the positive electrode and the negative electrode of the fluorescent lamps are connected to a power source and a high voltage are imposed between the positive electrode and the negative electrode, the mercury is vaporized and the negative electrode emits electrons to the positive electrode. The electrons collide with gas molecules of the vaporized mercury to generate ultraviolet rays. The ultraviolet rays are turned to visible lights after colliding into the fluorescent powders. The visible lights pass through the lamp body of the fluorescent lamp via gaps amount the fluorescent powders to form a light source.

However, the inner surface of the lamp body of the conventional fluorescent lamp is wholly coated with the fluorescent powders, so part of the visible lights inside the lamp body is reflected by the fluorescent powders and cannot pass through the lamp body. An appreciable proportion of the visible lights is repeatedly reflected inside the lamp body by the fluorescent powders, gradually decays and finally transforms into waste heat. Because part of the visible lights cannot pass through the lamp body, a luminance of the fluorescent lamp is lowered and inefficient.

SUMMARY OF THE INVENTION

The primary objective of the present invention is to provide a lamp body for a fluorescent lamp to improve a luminance of the fluorescent lamp.

The lamp body has an inner surface. The inner surface is separated into multiple sections. The multiple sections are arranged on the inner surface of the lamp body and include at least one coated section coated with fluorescent powders and at least one non-coated section being naked and kept free from fluorescent powders. Thus, when ultraviolet rays collide into the fluorescent powders and generate visible lights, the at least one non-coated section allows the visible lights to directly pass through the lamp body to improve a luminance of the fluorescent lamp.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
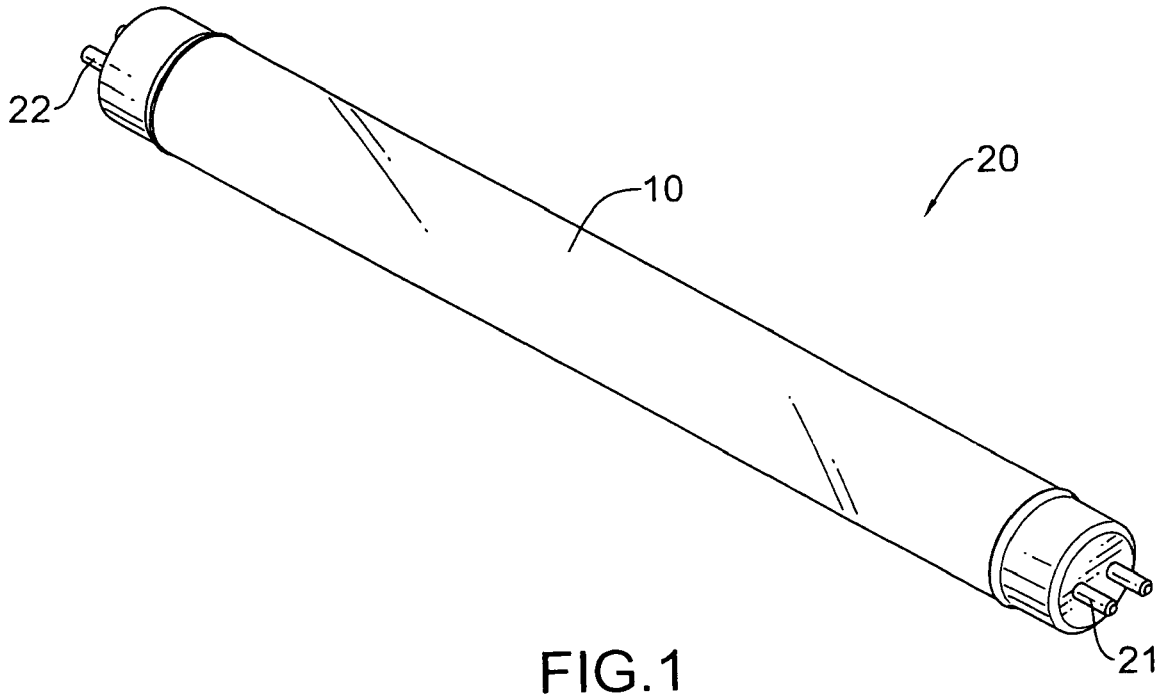
FIG. 1 is a perspective view of a first embodiment of a lamp body for a fluorescent lamp in accordance with the present invention.
Figure 4:
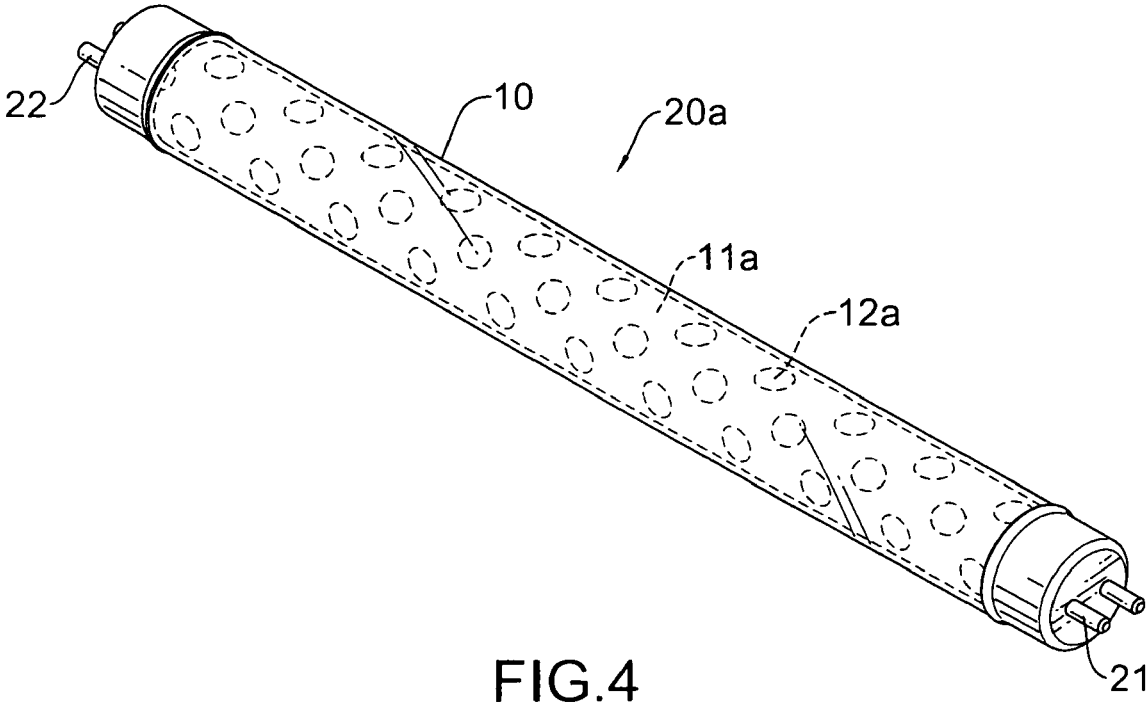
FIG. 4 is a perspective view of a second embodiment of a lamp body for a fluorescent lamp in accordance with the present invention.
Figure 5:
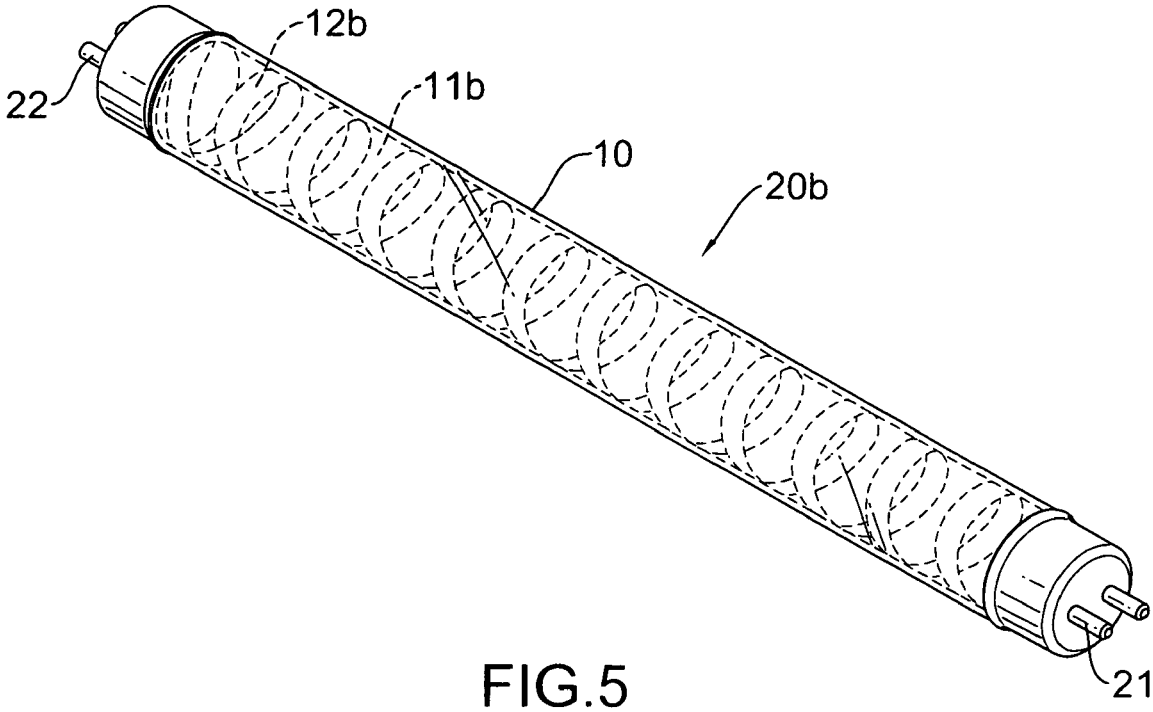
FIG. 5 is a perspective view of a third embodiment of a lamp body for a fluorescent lamp in accordance with the present invention.

With reference to FIGS. 1, 4 and 5, the fluorescent lamp (20, 20*a*, 20*b*) has a lamp body (10) in accordance with the present invention, a positive electrode (21) and a negative electrode (22). The lamp body (10) is filled with mercury and inert gas and has two ends and an inner surface.

With further reference to FIGS. 1, 2, 4 and 5, the inner surface of the lamp body (10) has multiple sections. The sections are arranged on the inner surface of the lamp body (10), include at least one coated section (11, 11*a*, 11*b*) and at least one non-coated section (12, 12*a*, 12*b*) and may be implemented in several ways. The at least one coated section (11, 11*a*, 11*b*) is coated with fluorescent powders (13) to generate visible lights when ultraviolet rays collide into the fluorescent powders (13). Part of the visible lights may pass through the lamp body (10) via gaps amount the fluorescent powders (13) and part of the visible lights may be reflected back to the lamp body (10) by the fluorescent powders (13). The at least one non-coated section (12, 12*a*, 12*b*) is naked and is kept free from fluorescent powders to allow visible lights to pass through the lamp body (10) to form a light source. Thus, a proportion of the visible lights passing through the lamp body is increased and a luminance of the fluorescent lamp is improved.

Figure 2:
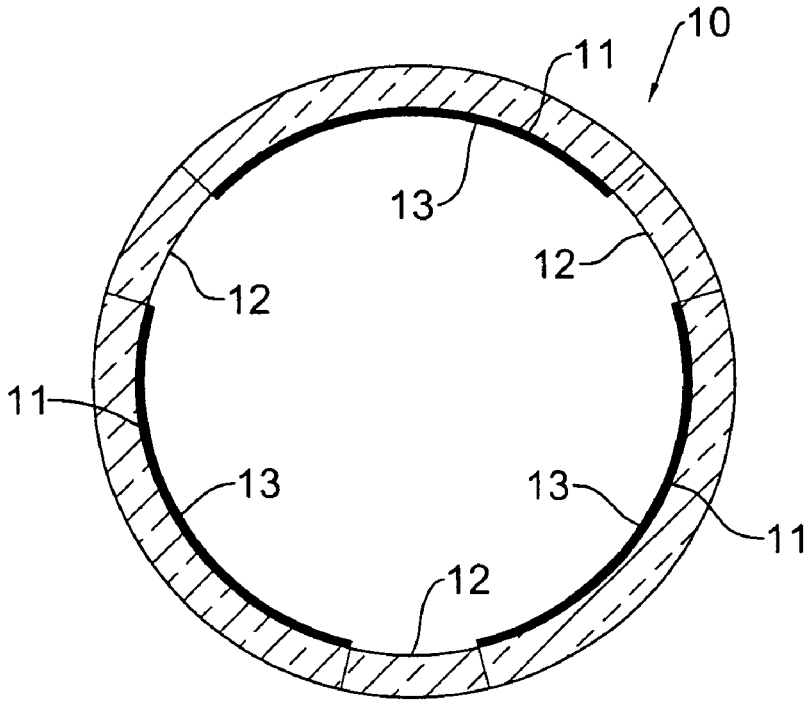
FIG. 2 is a cross-sectional side view of the lamp body in FIG. 1.
Figure 3:
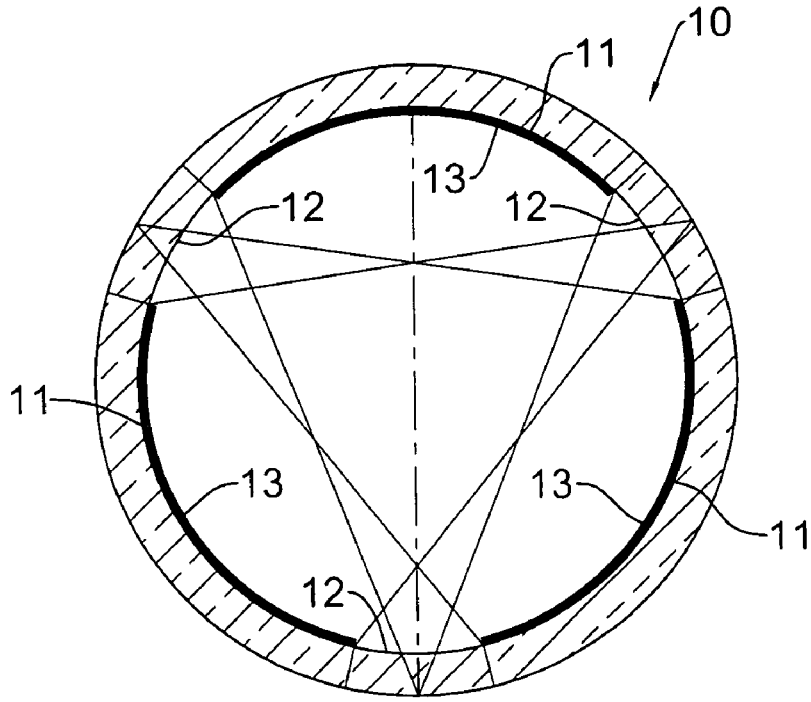
FIG. 3 is an operational cross-sectional side view of the lamp body in FIG. 1.

With further reference to FIGS. 2 and 3, in a first embodiment of the sections of the inner surface of the lamp body (10), the sections are arranged circularly and consecutively on the inner surface of the lamp body, respectively are an elongated curved area extending axially along the lamp body (10) and may include three coated sections (11) and three non-coated sections (12). The coated sections (11) are arranged on the inner surface of the lamp body (10) at intervals. Because each of the sections is an elongated curved area, each of the coated sections is analogous to a concave mirror and has an effect to converge the visible lights that are reflected by the coated section. The non-coated sections (12) are arranged respectively between the coated sections (11) and each of the non-coated sections (12) diametrically faces one of the coated sections (11). Thus, the visible lights converged by the coated sections (11) are more likely to pass out of the lamp body (10) through a corresponding one of the non-coated sections (12) to avoid unnecessary and repeated reflection. The proportion of the visible lights to pass through the lamp body is further increased and a luminance of the fluorescent lamp is further improved. To generate enough visible lights and to avoid a surfeit of visible lights to be reflected simultaneously, an appropriate percentage of the fluorescent powders (13) occupying the inner surface of the lamp body (10) is 75 to 95 percent, i.e. an appropriate percentage of the coated sections occupying the inner surface of the lamp body (10) is 75 to 95 percent.

With further reference to FIG. 4, in a second embodiment of the sections, the sections include multiple non-coated sections (12*a*) and a single coated section (11*a*). The non-coated sections (12*a*) respectively are a round curved area and are distributed on the inner surface of the lamp body (10). The coated section (11*a*) is arranged on the inner surface of the lamp body (10) exclusive of the non-coated sections (12*a*).

With further reference to FIG. 5, in a third embodiment of the sections, the sections are arranged spirally and consecutively on the inner surface of the lamp body (10) and respectively are an elongated spiral area.

The positive electrode (21) and the negative electrode (22) are mounted respectively at the two ends of the lamp body (10). When the positive electrode (21) and the negative electrode (22) are connected to a power source and a high voltage are imposed between the positive electrode (21) and the negative electrode (22), the mercury in the lamp body (10) is vaporized and the negative electrode (22) emits electrons to the positive electrode (21). The electrons collide with gas molecules of the vaporized mercury to generate ultraviolet rays. When the ultraviolet rays collide into the fluorescent powders (13) coated on the at least one coated section (11, 11*a*, 11*b*), the ultraviolet rays are transformed into visible lights.

Figure 6:
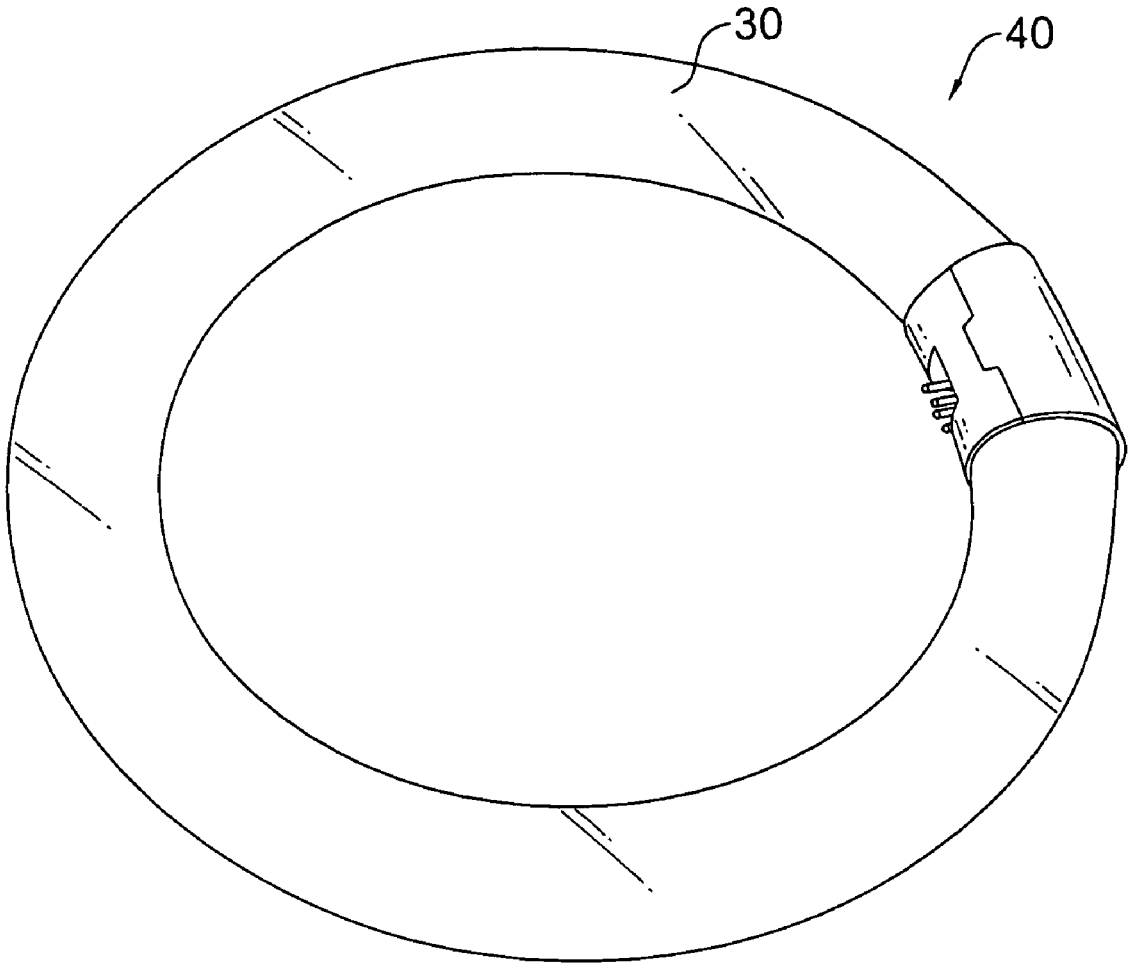
FIG. 6 is a perspective view of a forth embodiment of a lamp body in accordance with the present invention.
Figure 7:
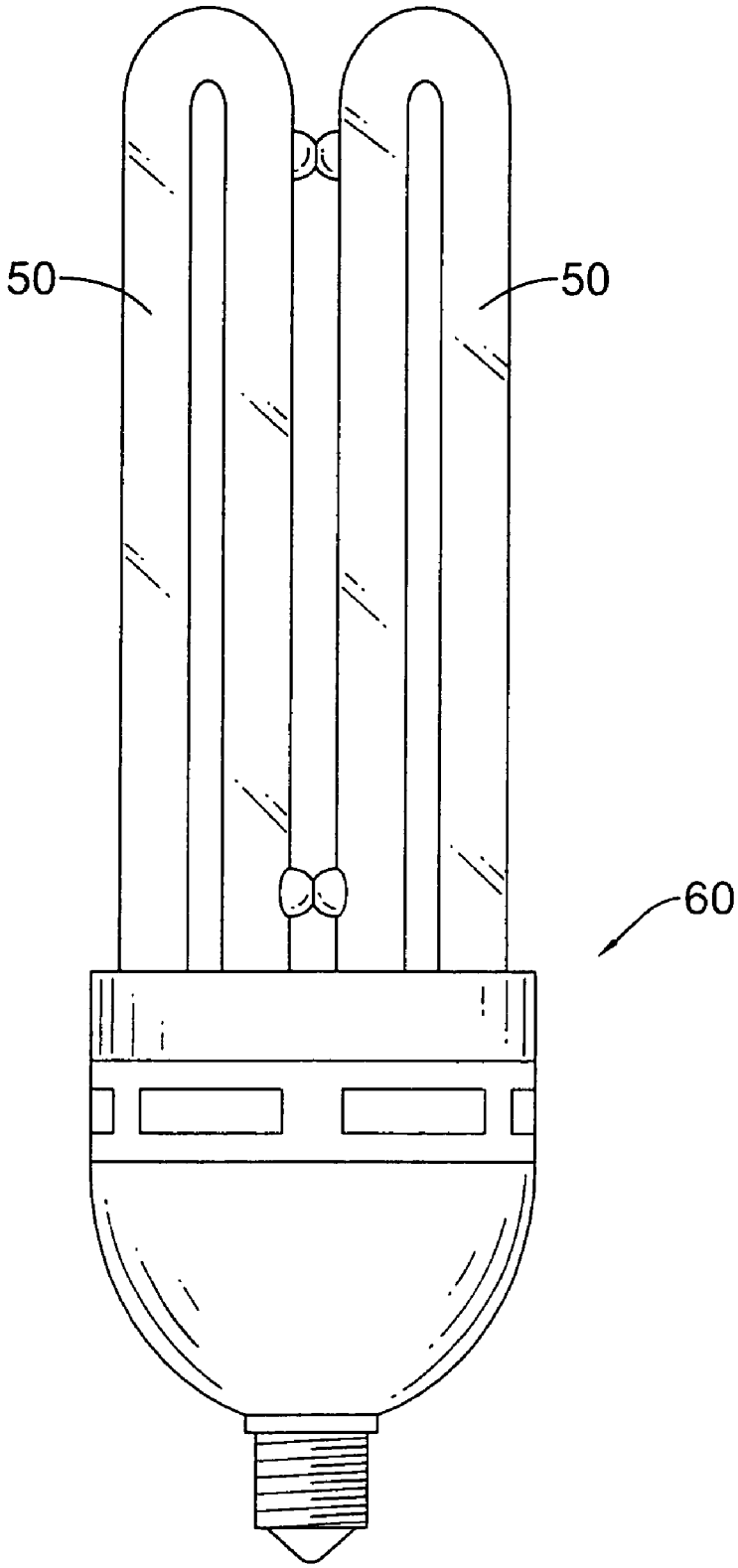
FIG. 7 is a perspective view of a fifth embodiment of a lamp body in accordance with the present invention.

With well proportioning the fluorescent powders (13) on the inner surface of the tube body (10) to form the at least one non-coated section, the proportion of the visible lights to pass through the lamp body (10) is increased and the luminance of the fluorescent lamp is improved. Further, with reference to FIGS. 1, 6 and 7, the lamp body (10, 30, 50) may be a straight lamp body (10) to be adapted to a straight fluorescent lamp (20, 20*a*, 20*b*), a circular lamp body (30) to be adapted to a circular fluorescent lamp (40) or a U-shape lamp body (50) to be adapted to a 5U energy saving fluorescent lamp (60).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp body for a fluorescent lamp comprising:

an inner surface having multiple sections arranged on the inner surface of the lamp body, the sections including multiple non-coated sections being naked and kept free from fluorescent powders, and respectively being a round curved area and distributed on the inner surface of the lamp body; and a single coated section coated with fluorescent powders and arranged on the inner surface of the lamp body exclusive of the non-coated sections.

2. The lamp body as claimed in claim 1, wherein the lamp body is straight.

3. The lamp body as claimed in claim 1, wherein the lamp body is circular.

4. The lamp body as claimed in claim 1, wherein the lamp body is U-shape.

5. A lamp body for a fluorescent lamp comprising:

an inner surface having multiple sections arranged on the inner surface of the lamp body and including, at least one coated section coated with fluorescent powders; and at least one non-coated section being naked and kept free from fluorescent powders, wherein the sections are arranged spirally and consecutively on the inner surface of the lamp body and respectively are an elongated spiral area.

6. The lamp body as claimed in claim 5, wherein the lamp body is straight.

7. The lamp body as claimed in claim 5, wherein the lamp body is circular.

8. The lamp body as claimed in claim 5, wherein the lamp body is U-shape.

* * * * *